US009937389B2

(12) United States Patent
Kitagawa et al.

(10) Patent No.: US 9,937,389 B2
(45) Date of Patent: Apr. 10, 2018

(54) GOLF CLUB HEAD WITH GROOVES SHALLOWER THAN SCORELINES AND SURFACE FILM THICKNESS

(71) Applicant: BRIDGESTONE SPORTS CO., LTD, Minato-ku, Tokyo (JP)

(72) Inventors: Tomonori Kitagawa, Tokyo (JP); Wataru Ban, Chichibu (JP)

(73) Assignee: BRIDGESTONE SPORTS CO., LTD, Minato-ku, Tokyo (JP)

( * ) Notice: Subject to any disclaimer, the term of this patent is extended or adjusted under 35 U.S.C. 154(b) by 61 days.

(21) Appl. No.: 14/792,749

(22) Filed: Jul. 7, 2015

(65) Prior Publication Data

US 2016/0008677 A1 Jan. 14, 2016

(30) Foreign Application Priority Data

Jul. 9, 2014 (JP) ..... 2014-141762

(51) Int. Cl.
*A63B 53/04* (2015.01)

(52) U.S. Cl.
CPC .. *A63B 53/0466* (2013.01); *A63B 2053/0408* (2013.01); *A63B 2053/0445* (2013.01)

(58) Field of Classification Search
CPC ..... A63B 53/0466; A63B 53/04; A63B 2053/0445; A63B 2060/004; A63B 2053/042
USPC ..... 473/330, 331, 342
See application file for complete search history.

(56) References Cited

U.S. PATENT DOCUMENTS 2,908,502 A * 10/1959 Bradstreet ..... A63B 53/04 191/1 A
4,768,787 A * 9/1988 Shira ..... A63B 53/04 473/331
5,755,626 A * 5/1998 Shira ..... A63B 53/04 473/330
5,851,158 A * 12/1998 Winrow ..... C23C 4/12 473/330
6,381,828 B1 * 5/2002 Boyce ..... A63B 53/02 148/669
6,679,788 B1 * 1/2004 Heinrich ..... C23C 4/12 473/324
6,719,643 B1 * 4/2004 Helmstetter ..... A63B 53/04 473/305
6,994,636 B2 * 2/2006 Hocknell ..... A63B 53/0466 473/342

(Continued)

FOREIGN PATENT DOCUMENTS

JP 2002-153575 A 5/2002
JP 2003-299753 A 10/2003
JP 2004-201787 A 7/2004

OTHER PUBLICATIONS

IOPScience, Analysis of the Laser Grooving and Cutting Processes, Woo Chun Choi and George Chryssolouris, http://iopscience.iop.org/article/10.1088/0022-3727/28/5/007/pdf, Dec. 1994.

*Primary Examiner* — William Pierce
(74) *Attorney, Agent, or Firm* — Sughrue Mion, PLLC

(57) ABSTRACT

A golf club head according to this invention is a wood type golf club head including a face portion, a crown portion, and a sole portion. A plurality of grooves are formed in the face portion. The depth of the plurality of grooves is less than 0.025 mm. A film having a thickness not more than the depth is formed on the face portion by a surface treatment.

15 Claims, 4 Drawing Sheets

(56) References Cited

U.S. PATENT DOCUMENTS 7,087,268 B2 * 8/2006 Byrne ..... A63B 53/0466 427/304
7,918,747 B2 * 4/2011 Johnson ..... A63B 53/04 473/328
8,172,699 B2 * 5/2012 Nakamura ..... A63B 53/047 473/330
8,961,333 B2 * 2/2015 Ballenger ..... A63B 53/0487 473/330
2002/0049095 A1 * 4/2002 Galloway ..... A63B 53/04 473/330
2002/0052247 A1 * 5/2002 Helmstetter ..... A63B 53/02 473/290
2002/0111228 A1 * 8/2002 Chang ..... A63B 53/04 473/324
2003/0032498 A1 * 2/2003 Erb ..... A63B 53/04 473/331
2003/0060306 A1 * 3/2003 Aldrich ..... A63B 53/04 473/342
2004/0192465 A1 9/2004 Erb et al.
2005/0113186 A1 * 5/2005 Newman ..... A63B 53/047 473/342
2005/0215350 A1 * 9/2005 Reyes ..... A63B 53/0466 473/344
2006/0058115 A1 * 3/2006 Erickson ..... A63B 53/0466 473/342
2006/0211514 A1 * 9/2006 Deshmukh ..... A63B 53/0466 473/342
2008/0051212 A1 * 2/2008 Voges ..... A63B 53/0466 473/331
2010/0009773 A1 1/2010 Beach
2010/0113179 A1 * 5/2010 Solheim ..... A63B 53/047 473/331
2010/0234134 A1 * 9/2010 Wahlin ..... A63B 53/04 473/342
2011/0111883 A1 * 5/2011 Cackett ..... A63B 53/047 473/331
2011/0269567 A1 * 11/2011 Ban ..... A63B 53/047 473/331
2012/0157227 A1 * 6/2012 Morin ..... A63B 53/0466 473/330
2012/0214611 A1 * 8/2012 Myrhum ..... A63B 53/0466 473/330
2012/0264537 A1 * 10/2012 Breier ..... A63B 53/04 473/331
2013/0040756 A1 * 2/2013 Myrhum ..... A63B 53/0466 473/342
2013/0053171 A1 * 2/2013 Carlyle ..... A63B 53/047 473/331
2013/0085012 A1 * 4/2013 Boyd ..... A63B 53/04 473/342
2013/0281226 A1 * 10/2013 Ban ..... B23K 26/367 473/331
2013/0324301 A1 * 12/2013 Boyd ..... A63B 53/04 473/342
2014/0080633 A1 * 3/2014 Bezilla ..... A63B 53/06 473/342
2014/0148271 A1 * 5/2014 Myrhum ..... A63B 53/04 473/342
2014/0206472 A1 * 7/2014 Aguayo ..... B23K 26/0084 473/331
2014/0206473 A1 * 7/2014 Ripp ..... B21D 22/00 473/331
2014/0274437 A1 * 9/2014 Boyd ..... A63B 53/04 473/233
2015/0057100 A1 * 2/2015 Serrano ..... A63B 53/065 473/331
2015/0119165 A1 * 4/2015 Sander ..... A63B 53/0466 473/342
2015/0367196 A1 * 12/2015 Schweigert ..... A63B 53/0466 473/342
2015/0367197 A1 * 12/2015 Ripp ..... A63B 53/047 473/331
2015/0367199 A1 * 12/2015 Shimahara ..... A63B 53/047 473/331

* cited by examiner

GOLF CLUB HEAD WITH GROOVES SHALLOWER THAN SCORELINES AND SURFACE FILM THICKNESS

BACKGROUND OF THE INVENTION

Field of the Invention

The present invention relates to a wood type golf club head.

Description of the Related Art

Generally, a golf club head is believed to increase the back spin amount of a shot when the surface roughness of the face portion increases. A maximum distance performance-oriented wood type golf club head is known to be unable to obtain a long carry of a shot if the back spin amount of the shot is large. However, also known is that a long carry of a shot cannot be obtained if the back spin amount is too small. In the wood type golf club head, when forming grooves such as score lines in the face portion, the number of grooves tends to be relatively small. Additionally, in the wood type golf club head, the face portion is sometimes made thin to improve the coefficient of restitution of the face portion. However, the strength of the thin face portion may lower. Hence, there are proposed techniques of making grooves shallow for the purpose of preventing the strength of the face portion from lowering when forming grooves in it (Japanese Patent Laid-Open Nos. 2003-299753 and 2002-153575 and U.S. Patent Application Publication Nos. 2003/0032498, 2004/0192465, and 2010/0009773).

On the other hand, in a golf club head having a relatively small loft angle (for example, 20° or less), the larger the surface roughness of the face portion is, the smaller the back spin amount may be. A golf club head described in Japanese Patent Laid-Open No. 2004-201787 is based on an idea of decreasing the surface roughness of the face portion at a position where the back spin amount decreases and increasing the surface roughness of the face portion at a position ere the back spin amount increases. That is, the golf club head is based on the reverse of a general idea concerning the relationship between the roughness of the face portion and the back spin amount of a shot.

In a wood type golf club head represented by a driver or a spoon, since the loft angle is relatively small, the surface roughness of the face portion is preferably made large to decrease the back spin amount of a shot. As a method of adjusting the surface roughness of the face portion, a process such as sand blast or shot peening is known. However, the process may be difficult or may require effort. As another method of adjusting the surface roughness of the face portion, contriving score lines is considerable. However, in, for example, a golf club head for games, a problem may arise in terms of conformity to rules (R & A rules).

On the other hand, if the surface roughness of the face portion is increased, the quality may degrade as the face portion readily wears or attains a poor appearance.

SUMMARY OF THE INVENTION

It is an object of the present invention to relatively easily increase the surface roughness of the face portion of a wood type golf club head and suppress degradation in the quality of the face portion.

According to an aspect of the present invention, there is provided a wood type golf club head including a face portion, a crown portion, and a sole portion, wherein a plurality of grooves are formed in the face portion, a depth of the plurality of grooves is less than 0.025 mm, and a film having a thickness not more than the depth is formed on the face portion by a surface treatment.

Further features of the present invention will become apparent from the following description of exemplary embodiments (with reference to the attached drawings).

DESCRIPTION OF THE EMBODIMENTS

Figure 1:
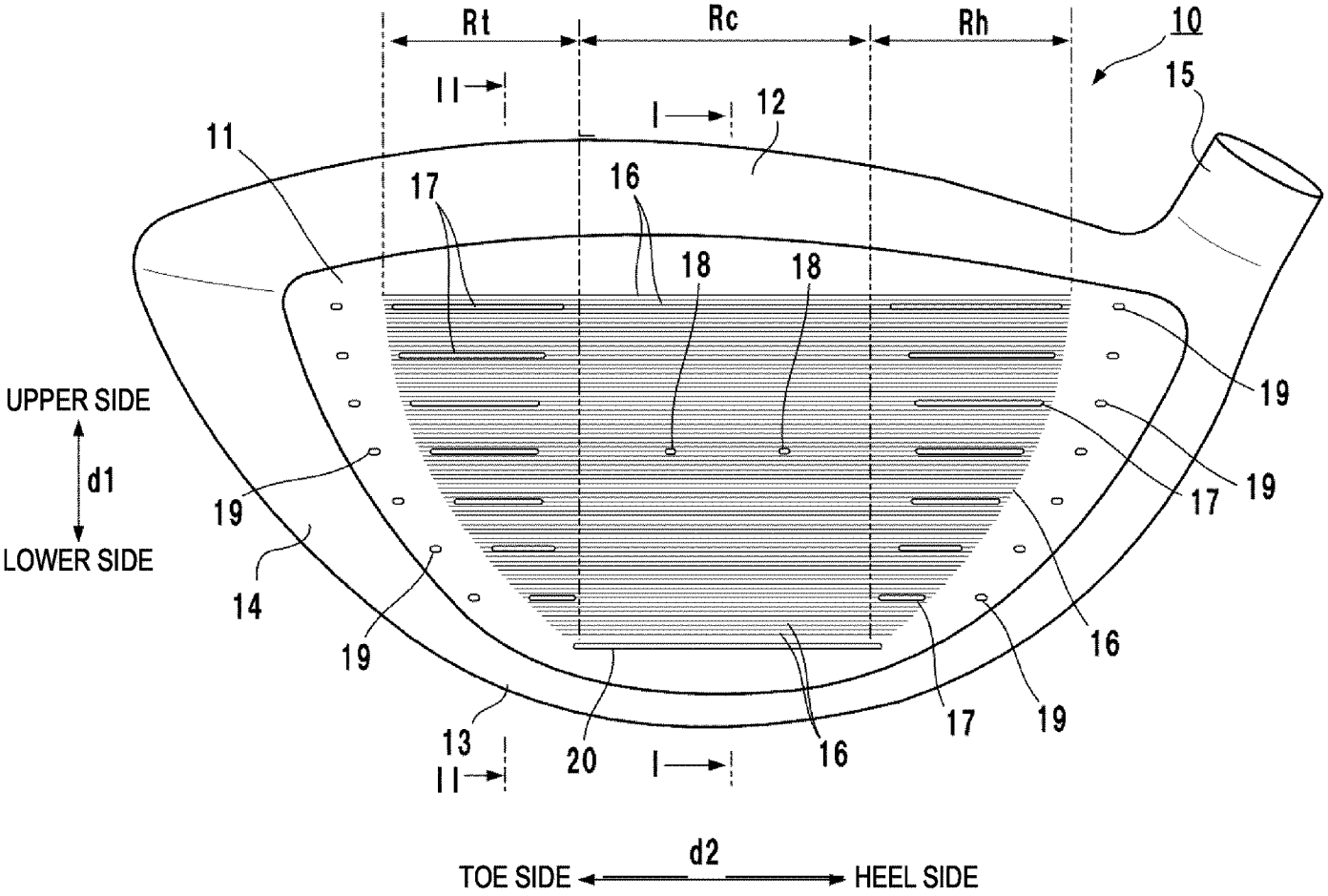
FIG. 1 is a view showing the outer appearance of a golf club head according to an embodiment of the present invention.

FIG. 1 is a view showing the outer appearance of a golf club head 10 according to an embodiment of the present invention. FIG. 1 is a view of the golf club head 10 viewed from the side of a face portion 11.

The golf club head 10 forms a hollow member and includes the face portion 11, a crown portion 12, a sole portion 13, and a side portion 14 which from peripheral walls. The surface of the face portion 11 forms a face (striking face). A bulge and a roll are formed on the face. The crown portion 12 forms the upper portion of the golf club head 10. The sole portion 13 forms the bottom portion of the golf club head 10. The side portion 14 forms the portion between the sole portion 13 and the crown portion 12. The golf club head 10 includes a hosel portion 15 to which a shaft is attached.

An arrow d1 in FIG. 1 indicates the up-and-down direction of the face portion 11, and an arrow d2 indicates the toe-heel direction. The toe-heel direction can be defined as, for example, a direction in which the toe-side end and the heel-side end of the sole portion 13 are connected or a direction perpendicular to the face-back direction. The up-and-down direction of the face portion 11 is defined based on the golf club head grounded in accordance with a predetermined lie angle. In this embodiment, the up-and-down direction is the direction of sole portion 13—crown portion 12.

The golf club head 10 is a golf club head for a driver. However, the present invention is applicable to wood type golf club heads including a fairway wood other than drivers. The present invention is particularly suitable for a golf club head having a loft angle of 20° or less.

The golf club head 10 can be made of a metal material. Examples of the metal material are a titanium-based metal (for example, titanium alloy 6Al-4V-Ti), stainless steel, and a copper alloy such as beryllium copper.

The golf club head 10 can be assembled by joining a plurality of parts. For example, the golf club head 10 can be formed from a main body member and a face member. The main body member forms the peripheral portions including the crown portion 12, the sole portion 13, the side portion 14, and the face portion 11. An opening is formed at part of the portion corresponding to the face portion 11. The face member is joined to the opening of the main body member.

A plurality of shallow grooves 16, score lines 17 and 20, and dot-shaped grooves 18 and 19 are formed in the surface of the face portion 11. These components will be described with reference to FIGS. 2A and 2B in addition to FIG. 1.

Figure 2A:
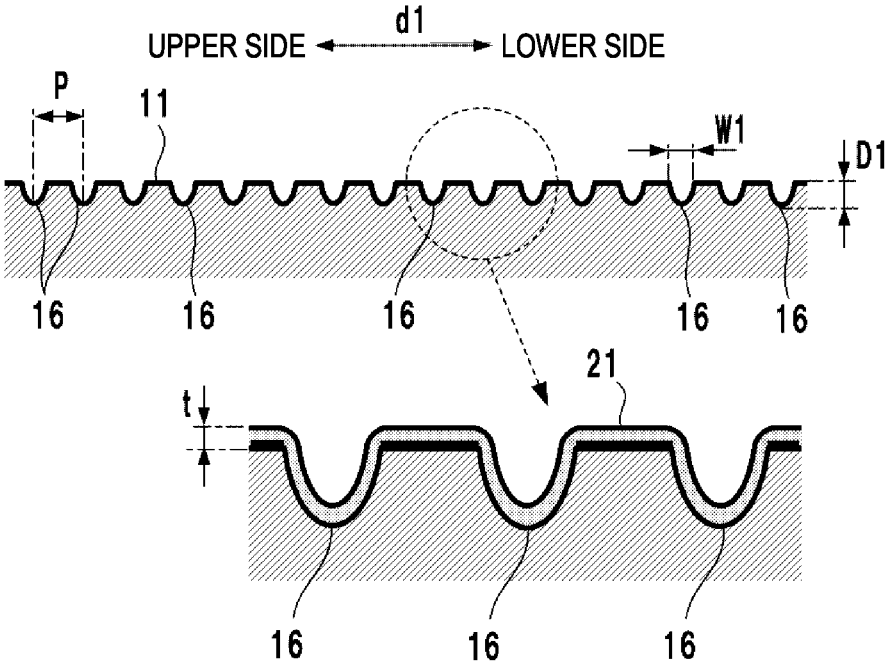
FIGS. 2A and 2B are partial sectional views of the golf club head shown in FIG. 1.
Figure 2B:
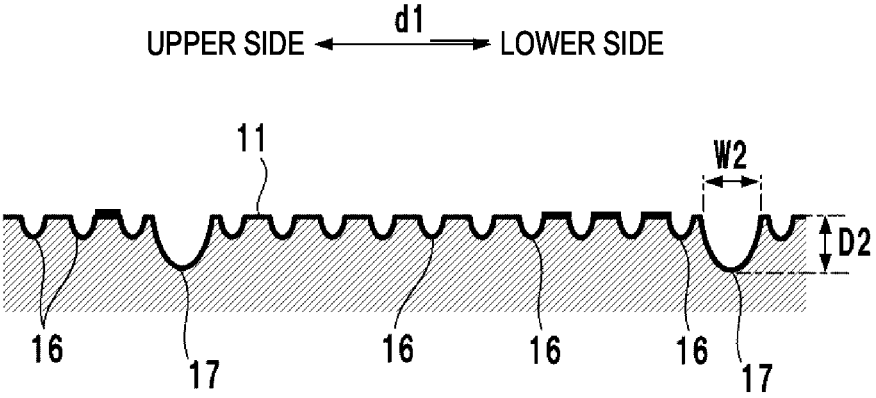

FIG. 2A shows a partial sectional view of the face portion 11 taken along a line I-I in FIG. 1 and a partially enlarged view of it. FIG. 2B is a partial sectional view of the face portion 11 taken along a line II-II in FIG. 1.

The plurality of shallow grooves 16 are arrayed in the up-and-down direction (direction d1) of the face portion 11. In this embodiment, the shallow grooves 16 are straight grooves extending in the toe-heel direction (direction d2) and are parallel to each other. The shallow grooves 16 are formed so as to be level when the golf club head 10 is grounded toward the target direction. In this embodiment, each shallow groove 16 is formed straight without any break. However, it may break halfway.

A depth D1 of each shallow groove 16 is less than 0.025 mm. For this reason, the shallow grooves 16 are handled not as so-called score lines but as elements (for example, elements by milling) that roughen the face under the rules (R & A rules) of golf club heads. The shallow grooves 16 are formed to adjust the surface roughness of the face. Hence, the depth D1 is preferably 0.003 mm or more. A width W1 of each shallow groove 16 preferably ranges from 0.05 mm (inclusive) to 0.3 mm (inclusive). The width W1 is the width of each shallow groove 16 in the up-and-down direction (the planar direction of the face in the direction d1).

In this embodiment, the cross section of each shallow groove 16 has an elliptic arc outline. However, the outline shape of the cross section of each shallow groove 16 is not limited to this, and various outline shapes such as an arc shape, triangular shape, rectangular shape, and trapezoidal shape can be employed.

As shown in FIG. 2A, a pitch P is set between the shallow grooves 16 adjacent in the up-and-down direction. The surface roughness of the surface of the face portion 11 can be adjusted by the pitch P. The pitches P can be either equal pitches or different pitches. At any rate, each pitch P between the grooves preferably ranges from 0.1 mm (inclusive) to 1 mm (inclusive). If the pitch P is smaller than 0.1 mm, the durability of the face portion 11 between the shallow grooves 16 may lower. If the pitch P exceeds 1 mm, the effect of suppressing the back spin amount on a golf ball may weaken.

In this embodiment, the plurality of shallow grooves 16 are formed from the center portion of the face portion 11 to the toe-side portion and the heel-side portion. In FIG. 1, the formation region of the plurality of shallow grooves 16 is virtually divided in the direction d2. The central portion is expressed as Rc, the toe-side portion as Rt, and the heel-side portion as Rh. The central portion Rc may be, for example, an impact area. In a driving club or a fairway wood, the impact area is a band-shaped portion passing through the center of the club face and having a width of 1.68 inches (42.67 mm) under the rules (R & A rules).

In this embodiment, out of the plurality of shallow grooves 16, the shallow grooves 16 on the upper side (the side of the crown portion 12) in the direction d1 are relatively long in the direction d2, and the shallow grooves 16 on the lower side (the side of the sole portion 13) in the direction d1 are relatively short in the direction d2. For this reason, the formation region of the plurality of shallow grooves 16 has a cup shape.

In general, the face portion 11 is wide in the direction d2 on the side of the crown portion 12 and narrow in the direction d2 on the side of the sole portion 13. When the formation region of the plurality of shallow grooves 16 has a cup shape, the shallow grooves 16 can be formed in a wide range along the outline of the face portion 11.

Figure 4:
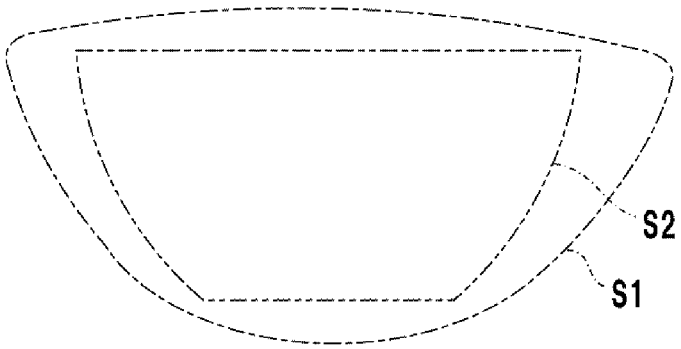
FIG. 4 is an explanatory view of the area ratio of a face portion to a shallow groove formation region.

When the shallow grooves 16 are formed in a wide range, a golf ball comes into contact with the shallow grooves 16 at a high possibility, and the back spin amount suppressing effect can easily be obtained even if the impact point varies at impact. As shown in FIG. 4, let S1 be the area of the face portion 11, and S2 be the area of the formation region of the shallow grooves 16. The area S2 is preferably 50% or more, particularly, 60% or more of the area S1. As a specific numerical value, the area S1 is, for example, about 4,000 $mm^2$ in a head for a driver. However, the numerical value varies depending on the shape of the face portion or the head volume.

The area S1 of the face portion 11 can be the area of a range recognized as the face portion 11 in terms of outer appearance. If the range of the face portion 11 is indefinite, the range of the face portion 11 is delimited based on, for example, the boundary between the face portion 11 and the crown portion 12, the sole portion 13, and the side portion 14 (a portion where the curvature abruptly changes). The boundary on the side of the hosel portion 15 is delimited from the extension of the already delimited boundary between the face portion 11 and the crown portion 12 and the extension of the already delimited boundary between the face portion 11 and the sole portion 13 or the side portion 14 on the heel side. The formation region of the shallow grooves 16 is delimited as, for example, a minimum region including all the shallow grooves 16. In the example of FIG. 1, the formation region of the shallow grooves 16 can be delimited as a cup-shaped region surrounded by the shallow groove 16 located closest to the crown portion 12, the shallow groove 16 located closest to the sole portion 13, and virtual lines connecting the ends of the shallow grooves 16 located between them.

In this embodiment, a film 21 is formed on the surface of the face portion 11 by a surface treatment, as shown in FIG. 2A. When the plurality of shallow grooves 16 are formed, and the surface roughness increases, the quality may degrade as the face portion 11 readily wears or attains a poor appearance. When the film 21 is formed by a surface treatment, such degradation in the quality can be suppressed. A thickness t of the film 21 is equal to or smaller than the depth D1 of the shallow grooves 16. This can prevent the shallow grooves 16 from being filled with the film 21. The thickness t preferably ranges from, for example, 1 μm (inclusive) to 10 μm (inclusive).

As the surface treatment, for example, ion plating or a DLC (Diamond Like Carbon) process is usable. These surface treatments also make it possible to, for example, protect the shallow grooves 16, improve the durability of the shallow grooves 16, adjust the surface color of the face portion 11, and improve the outer appearance.

The score lines 17 and 20 will be described next with reference to FIGS. 1, 2A, and 2B. In this embodiment, the score lines 17 and 20 are formed. However, a structure without the score lines 17 and 20 can also be employed.

The score lines 17 and 20 are straight grooves extending in the toe-heel direction and are formed in parallel to each other. A width W2 of each score line 17 can range from, for example, 0.3 mm (inclusive) to 0.9 mm (inclusive), and a depth D2 can range from, for example, 0.05 mm (inclusive) to 0.5 mm (inclusive). This also applies to the score line 20.

In this embodiment, the cross section of each score line 17 has an elliptic arc outline. However, the outline shape of the cross section of each score line 17 is not limited to this, and various outline shapes such as an arc shape, triangular shape, rectangular shape, and trapezoidal shape can be employed. This also applies to the score line 20.

The score line 20 is formed immediately under the formation region of the shallow grooves 16, and has the same length in the direction d2 as the shallow groove 16 located closest to the sole portion 13. The score line 20 allows a golfer to easily visually recognize the portion near the lower limit of the face portion 11 at impact.

In this embodiment, the plurality of score lines 17 are formed not in the central portion Rc but in the toe-side portion Rt and the heel-side portion Rh out of the formation region of the shallow grooves 16. The score lines 17 may be formed in the central portion Rc as well. However, the arrangement of this embodiment can have the following advantages.

In the portions Rt and Rh where the score lines 17 are formed, the formation region of the shallow grooves 16 is consequently smaller than in the central portion Rc. In general, if the impact point at impact is located on the toe side or heel side of the face portion 11, the side spin amount increases, as compared to a case where the impact point is located at the center, and the golf ball readily hooks or slices. However, even if the side spin amount increases, the amount of hook or slice of the shot can be made small when the back spin amount is large. The score lines 17 are formed to make the formation region of the shallow grooves 16 smaller in the portions Rt and Rh than in the central portion Rc. This can increase the back spin amount in case of impact in the portion Rt or Rh. In this case, although the carry of a shot decreases, the amount of hook or slice can be made small.

The dot-shaped grooves 18 and 19 will be described next with reference to FIG. 1. The width and depth of the grooves 18 and 19 can be the same as in the above-described example of the score lines 17 and 20. The grooves 18 and 19 can be wider and deeper than the shallow grooves 16. The outline shape of the cross section of each of the grooves 18 and 19 can also be the same as in the above-described example of the score lines 17 and 20. Note that a structure without the grooves 18 and 19 can also be employed.

The grooves 18 are formed at the center of the face portion 11 in the directions d1 and d2. In this embodiment, two grooves 18 are formed while being spaced apart in the direction d2. The number of grooves 18 can be one or three or more. Each groove 18 need not always have a dot shape and can be a straight groove or have another shape. The grooves 18 are preferably formed in a virtual circle having a radius of 8 mm, particularly, a virtual circle having a radius of 6 mm with respect to the centroid of the face portion 11 as the center. The grooves 18 allow a golfer to easily visually recognize the portion near the center of the face portion 11 at impact.

It is also possible to adjust the coefficient of restitution of the central portion of the face portion 11 by the grooves 18. In a golf club head for a driver, the upper limit of the coefficient of restitution of the face portion is defined under the rules (R & A rules) of golf club heads. The coefficient of restitution of the face portion 11 can be adjusted by its wall thickness distribution. With the wall thickness distribution of the face portion 11, the repulsion performance at impact on portions other than the central portion can be improved while suppressing the maximum repulsion performance at impact at the center of the face portion 11. When the grooves 18 are formed at the central portion of the face portion 11, as in this embodiment, for example, if the repulsion performance at impact at the center of the face portion 11 becomes too low upon adjusting the wall thickness distribution, the repulsion performance can be improved by the grooves 18.

The grooves 19 are formed on the periphery of the face portion 11 on the side of the side portion 14. The grooves 19 allow a golfer to easily visually recognize the periphery of the face portion 11 at impact.

A method of forming the shallow grooves 16, the score lines 17 and 20, and the grooves 18 and 19 will be described next. As the method of forming the shallow grooves 16, machining, laser machining, chemical milling, etching, and press working are usable. Laser machining is preferably used. The same formation method as that of the shallow grooves 16 can be used for the score lines 17 and 20 and the grooves 18 and 19. Machining is preferably used, and casting or forging may also be used for formation.

As a procedure of processing, for example, a golf club head formed as a hollow member is fixed in a numerically controlled processing apparatus, thereby forming the shallow grooves 16 and the like in the face portion 11.

As another procedure of processing, when assembling the golf club head 10 by joining a plurality of parts, a flat face member is fixed in a numerically controlled processing apparatus, and the shallow grooves 16 and the like are formed. When formation of the shallow grooves 16 and the like is completed, the face member is bent to form a bulge and a roll. After that, the face member is joined to the opening of the main body member. In this procedure, since the face member is flat in the step of forming the shallow grooves 16 and the like, the shallow grooves 16 and the like can be formed more accurately.

As the order of forming the shallow grooves 16, the score lines 17 and 20, and the grooves 18 and 19, for example, the score lines 17 and 20 and the grooves 18 and 19 are formed first. After that, the shallow grooves 16 are formed. The surface treatment is performed at last to form the film 21.

As described above, in this embodiment, the surface roughness of the face portion 11 can be controlled by the pitch P between the shallow grooves 16. As a method of adjusting the surface roughness of the face portion, a process such as sand blast or shot peening is known. However, it is not necessarily easy to control the surface roughness to an intended roughness. In this embodiment, since the pitch P between the shallow grooves 16 is only controlled, it is relatively easy to control the surface roughness. In addition, since the shallow grooves 16 are not score lines under the rules (R & A rules), no restrictions concerning score lines are imposed. It is therefore possible to obtain the above advantages while conforming to the rules.

<Second Embodiment>

Figure 3A:
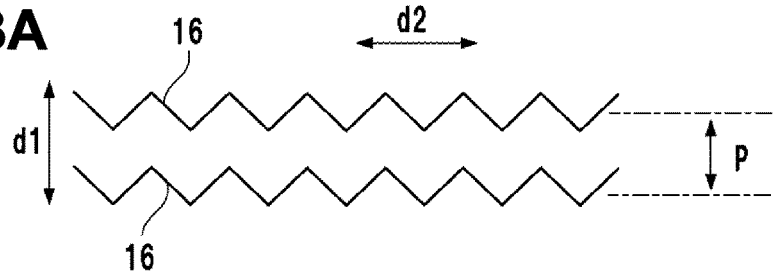
FIGS. 3A to 3E are explanatory views of other examples of shallow grooves.
Figure 3B:
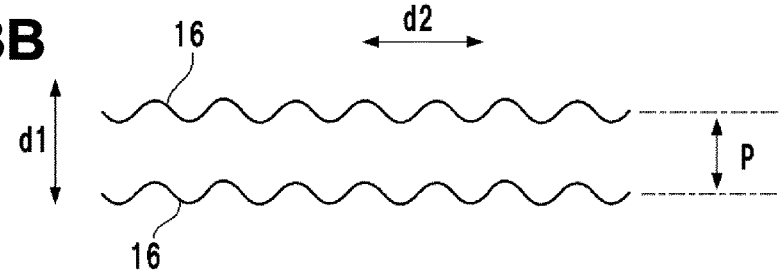

In the first embodiment, the shallow grooves 16 have been explained as straight grooves. However, shallow grooves 16 may be grooves having another shape. FIGS. 3A to 3D show examples. FIGS. 3A and 3B show examples of the shallow grooves 16 having wavy shapes. FIG. 3A shows a case where the shallow grooves 16 are formed into a triangular wave shape, and FIG. 3B shows a case where the shallow grooves 16 are formed into a sine wave shape. A pitch P uses, as a reference, the center between the upper and low ends of each shallow groove 16. The pitch P can use any reference as long as it is consistently determined.

Figure 3C:
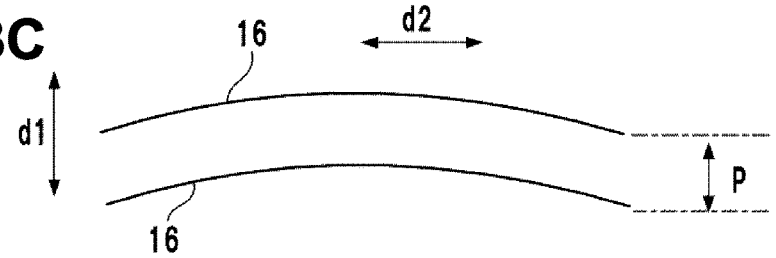

FIG. 3C shows an example in which the shallow grooves 16 are grooves having an arc shape. In this example, the pitch P uses an end of each shallow groove 16 as a reference.

Figure 3D:
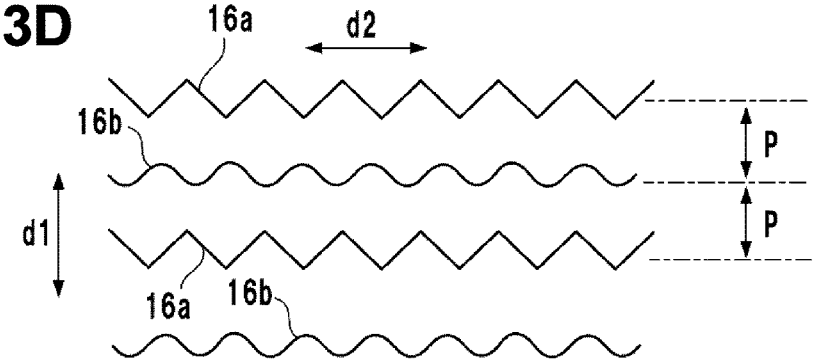

FIG. 3D shows an example in which shallow grooves 16*a* having a triangular wave shape and shallow grooves 16*b* having a sine wave shape are repetitively formed. As in this example, the shallow grooves 16 may be formed by periodically forming grooves having different shapes.

Figure 3E:
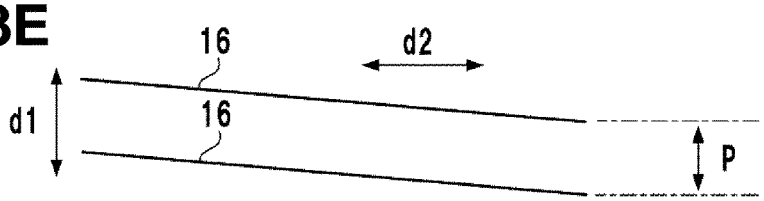

In the first embodiment, the shallow grooves 16 are formed so as to be level when the golf club head 10 is grounded toward the target direction. However, the shallow grooves 16 need not be level. FIG. 3E shows an example. FIG. 3E shows the shape of each shallow groove 16 when the golf club head 10 is grounded toward the target direction. The shallow grooves 16 tilt from a level state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-141762, filed Jul. 9, 2014, which is hereby incorporated by reference herein in its entirety.

What is claimed is:

1. A wood type golf club head including a face portion, a crown portion, and a sole portion, wherein a plurality of scorelines are formed in the face portion, a plurality of grooves having a depth shallower than a depth of the plurality of scorelines are formed in the face portion, the depth of the plurality of grooves is less than 0.025 mm, a film having a thickness not more than the depth of the plurality of grooves is formed on the face portion by a surface treatment, and grooves on a side of the crown portion in the plurality of grooves have lengths longer than lengths of grooves on a side of the sole portion in the plurality of grooves.

2. The golf club head according to claim 1, wherein the thickness is not more than 10 μm.

3. The golf club head according to claim 1, wherein the plurality of grooves are formed by laser machining.

4. The golf club head according to claim 1, wherein the surface treatment is ion plating.

5. The golf club head according to claim 1, wherein the surface treatment is a diamond like carbon process.

6. The golf club head according to claim 1, wherein the plurality of grooves are arrayed in an up-and-down direction of the face portion.

7. The golf club head according to claim 1, wherein each groove of the plurality of grooves comprises a straight groove extending in a toe-heel direction, and the plurality of grooves are arrayed in an up-and-down direction of the face portion at equal pitches.

8. The golf club head according to claim 1, wherein the thickness is not less than 1 μm.

9. The golf club head according to claim 1, wherein the depth of the plurality of grooves is not less than 0.003 mm.

10. The golf club head according to claim 1, wherein the width of the plurality of grooves ranges from 0.05 mm (inclusive) to 0.3 mm (inclusive).

11. The golf club head according to claim 1, wherein each pitch between adjacent grooves of the plurality of grooves ranges from 0.1 mm (inclusive) to 1 mm (inclusive).

12. The golf club head according to claim 1, wherein the lengths of the plurality of grooves are shorter the closer the respective groove is to the sole portion.

13. The golf club head according to claim 1, wherein a formation region of the plurality of grooves in the face portion has a cup shape.

14. The golf club head according to claim 1, wherein the score lines are formed in the toe-side portion and the heel-side portion, and the score lines are not formed in the central portion.

15. The golf club head according to claim 1, wherein a dot-shaped groove is formed in a central portion of the face portion.

* * * * *